US007477210B2

(12) United States Patent
Kim et al.

(10) Patent No.: US 7,477,210 B2
(45) Date of Patent: Jan. 13, 2009

(54) ADDRESS DATA PROCESSING DEVICE AND METHOD FOR PLASMA DISPLAY PANEL, AND RECORDING MEDIUM FOR STORING THE METHOD

(75) Inventors: Myoung-Kwan Kim, Seoul (KR); Jae-Seok Jeong, Cheonan-si (KR); Joon-Koo Kim, Asan-si (KR); Nam-Sung Jung, Yongin-si (KR); Tae-Kyoung Kang, Asan-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 789 days.

(21) Appl. No.: 10/840,169

(22) Filed: May 6, 2004

(65) Prior Publication Data

US 2004/0222949 A1 Nov. 11, 2004

(30) Foreign Application Priority Data

May 7, 2003 (KR) ..... 10-2003-0028969

(51) Int. Cl.
*G09G 3/28* (2006.01)

(52) U.S. Cl. ..... 345/60; 345/61; 345/62; 345/204

(58) Field of Classification Search ..... 345/60–63, 345/204

See application file for complete search history.

(56) References Cited

U.S. PATENT DOCUMENTS 6,157,398 A * 12/2000 Jeddeloh ..... 345/532
6,191,762 B1 * 2/2001 Kim ..... 345/60
6,608,610 B2 * 8/2003 Nagai ..... 345/63
7,142,251 B2 * 11/2006 Sha et al. ..... 348/557

* cited by examiner

*Primary Examiner*—Richard Hjerpe
*Assistant Examiner*—Leonid Shapiro
(74) *Attorney, Agent, or Firm*—Christie, Parker & Hale, LLP

(57) ABSTRACT

A PDP address data processor, a method thereof, and a recording medium for storing a program used to perform the method. The address data processor generates subfield data corresponding to RGB input video data, divides them into two sets of subfield data, and stores them in a frame memory using rising and falling edges of a reference clock signal of a frame memory. The address data processor reads and arranges the stored subfield data using the rising and falling edges to generate address data for representing gray on the PDP. The address data processor uses an RGB mixing algorithm for selecting two different video data from among the RGB input video data to select video data, and generates the subfield data corresponding to the selected video data.

22 Claims, 8 Drawing Sheets

ADDRESS DATA PROCESSING DEVICE AND METHOD FOR PLASMA DISPLAY PANEL, AND RECORDING MEDIUM FOR STORING THE METHOD

CROSS REFERENCE TO RELATED APPLICATION

This application claims priority to and the benefit of Korean Patent Application No. 2003-28969 filed on May 7, 2003 in the Korean Intellectual Property Office, the entire content of which is incorporated herein by reference.

BACKGROUND OF THE INVENTION (a) Field of the Invention

The present invention relates to a plasma display panel (PDP). More specifically, the present invention relates to an address data processing device and method for a PDP, and a recording medium for storing a program which includes a method for effectively storing subfield data in a frame memory to generate address data.

(b) Description of the Related Art

A PDP has a plurality of discharge cells arranged in a matrix format, which are configured to selectively emit light, thereby restoring original images using input electrical signals that contain image data.

The PDP has a gray display function for operating as a color display element, and uses a gray realization method for dividing a single field into a plurality of subfields and control them by a time-division rule.

Each subfield has an address interval and a sustain interval. Data for each pixel are transmitted to corresponding scan electrode and address electrode to selectively discharge or erase each cell in the address interval. In the sustain interval, the data for each pixel are maintained, thereby realizing the gray (i.e., gray level).

One of the generally used gray representation methods is an address display separation (ADS) method for completely separating the address interval and the sustain interval.

In the ADS driving method, only the intensity of radiation of the sustain interval is controlled to represent gray of the PDP, and gray representation (levels of from 0 to 255) of RGB video data is performed using ten to sixteen subfields within a single frame.

To display the RGB video data as PDP address data, the video data need to be converted to subfield data. For example, for the case of representing the gray of red 149, the values converted into subfield data using twelve subfields are shown in Table 1.

TABLE 1

| Subfields | SF 0 | SF 1 | SF 2 | SF 3 | SF 4 | SF 5 | SF 6 | SF 7 | SF 8 | SF 9 | SF 10 | SF 11 |
|---|---|---|---|---|---|---|---|---|---|---|---|---|
| Weights | 1 | 2 | 4 | 6 | 8 | 10 | 13 | 21 | 32 | 43 | 53 | 63 |
| Subfield data | 1 | 0 | 1 | 1 | 1 | 0 | 1 | 1 | 0 | 1 | 1 | 0 |

The subfield data generated for gray representation are arranged as address data for driving the PDP. To drive the PDP, the subfield data are stored in a frame memory.

FIG. 1 shows a block diagram of a conventional address data processor in the PDP.

As shown, the conventional address data processor uses six first input first output (FIFO) memories 11 through 16 to receive RGB video data. The memories 11 and 12 receive red (RED) even and odd data and output them, the memories 13 and 14 receive green (GRN) even and odd data and output them, and the memories 15 and 16 receive blue (BLU) even and odd data and output them.

For example, when the conventional PDP has a high definition (HD) level with a resolution of 1,366×768, the FIFO memories each output 8-bit video data.

Six subfield data generators 21 through 26 receive the RGB video data output from the six FIFO memories 11 through 16, respectively, generate subfield data for representing corresponding grays, and output the subfield data. In the case of using twelve subfields, the subfield data generators 21 through 26 each generate 12-bit subfield data for a corresponding cell, and output them as serial outputs.

The 12-bit subfield data outputs generated by the six subfield data generators 21 through 26 each relate to on/off states of the twelve subfields on the gray of a cell. Each of the 12-bit subfield data outputs is data arranged in series with respect to time.

In order to perform an address operation of the PDP, the subfield data of all the cells on a single horizontal line in the same time frame are to be output in parallel, and accordingly, six subfield matrices 31 through 36 receive the subfield data output by the six subfield data generators 21 through 26 into 16 neighboring cells, convert them into 16-bit parallel subfield data, and output them.

In this instance, since the two subfield matrices 21 and 22 respectively represent subfield data of sixteen neighboring cells corresponding to the red video data, and indicate even and odd data, when the respective 16-bit subfield data output by the two subfield matrices 21 and 22 are concatenated by using a concatenator 41, the red subfield data of the thirty-two cells, that is, 32-bit subfield data, are generated and output.

In the same manner, the green subfield data of thirty-two cells and the blue subfield data of thirty-two cells are generated and output, respectively, using the two subfield matrices 23 and 24 and a concatenator 43, and using the two subfield matrices 25 and 26 and a concatenator 45.

The respective 32-bit subfield data generated through the concatenators 41, 43, and 45 are stored in the corresponding frame memories 61 through 66 through the data buffers 51, 53, and 55, respectively. The frame memory 61 and 62 store the red subfield data, the frame memories 63 and 64 store the green subfield data, and the frame memories 65 and 66 store the blue subfield data.

Three subfield data arrangers 71, 73, and 75 receive the subfield data stored in the frame memories through the data buffers 51, 53 and 55, respectively, arrange them as data for per-subfield addressing (i.e., address data for each subfield), and output arranged data so as to represent gray on the PDP. That is, the subfield data arranger 71 receives the red subfield data stored in the frame memories 61 and 62 through the data buffer 51, arranges them, and outputs red address data; the subfield data arranger 73 receives the green subfield data stored in the frame memories 63 and 64 through the data buffer 53, arranges them, and outputs green address data; and the subfield data arranger 75 receives the blue subfield data stored in the frame memories 65 and 66 through the data buffer 55, arranges them, and outputs blue address data.

Regarding using two frame memories for the RGB data, the input video data of the (N−1)th frame are converted into subfield data, the converted subfield data are stored in a single frame memory, the subfield data of the (N−1)th frame stored in the corresponding frame memory are read at the start point of the Nth frame, and they are arranged to generate address data. In this instance, another frame memory is used because the input video data of the Nth frame are to be converted into subfield data and stored while the corresponding frame memory reads the subfield data of the (N−1)th frame. In other words, two frame memories are used since the operation of reading the subfield data of the (N−1)th frame and the operation of storing the subfield data of the Nth frame are concurrently performed in the Nth frame.

A use of six frame memories for processing the HD data is described below.

A high clock frequency should be used for a frame memory for storing video data because of the huge amount of video data converted into subfield data in the HD level PDP. However, a lower clock frequency may be used with an increased number of frame memories because of the limitations in the available clock frequencies. Also, since video data of a single horizontal line cannot be processed during a single horizontal sync at a lower clock frequency, the process is divided into respective RGB processes. The RGB process for each of the red, green and blue color components has even and odd processes. Therefore, the RGB video data are processed using six parallel processes.

It can be seen in FIGS. 1 and 2 that rising edges of the clock signal CLK are used to access the frame memories 61 through 66 through the data buffers 51, 53, and 55. In other words, the 32-bit subfield data are read and written at the rising edges of the clock signals CLK.

Since a PDP that displays HD-level video has high resolution, it has a huge volume of video data to be processed. Since all the subfield data of one frame should be read and written within a single frame time, a frame memory clock having a frequency higher than that of the frame memory clock for SD-level video should be used to display HD-level video. Therefore, the clock frequency for displaying the HD-level video shown in FIG. 3B is higher than the clock frequency for an access to the frame memory when displaying SD-level video shown in FIG. 3A.

The video data of the full HD-level resolution 1,920×1,080 in the PDP is double that of the video data of the HD-level resolution 1,366×768, and hence, the clock frequency must be doubled to process the corresponding data within one frame time. When the clock frequency is doubled, no margins of a setup time and a hold time between the data and the clock signals exist during the process of writing/reading data to/from the frame memory, and therefore data can be lost. Also, when the clock frequency is doubled, calorific values of logic ICs increase, power consumption increases, circuit reliabilities worsen because of the increase of the calorific values, and the PDP lifespan is shortened.

SUMMARY OF THE INVENTION

In exemplary embodiments of the present invention is provided a PDP address data processor and a method thereof for using a lesser number of frame memories without raising the clock frequency for accessing the frame memories when the PDP resolution becomes higher, thereby increasing the amount of data for video display.

In an exemplary embodiment of the present invention, an address data processor for a PDP includes:

a subfield data generator for receiving RGB video data, and generating corresponding subfield data;

a frame memory for storing the subfield data using a rising edge and a falling edge of a reference clock signal, and outputting the stored subfield data using the rising edge and the falling edge of the reference clock signal; and a subfield data arranger for receiving the subfield data output by the frame memory, arranging the subfield data as address data for each subfield, and outputting the address data to represent gray on the PDP.

In another exemplary embodiment, the processor further includes an RGB mixer for receiving the RGB video data, selecting data as a specific combination of the RGB video data, and outputting the selected data to the subfield data generator.

In yet another exemplary embodiment, the specific combination includes two different sets of video data selected from the RGB video data, and a selection order of the two sets of video data follows R→G→B and G→B →R, respectively. In still another exemplary embodiment, the processor further includes a subfield matrix for receiving the subfield data generated by the subfield data generator and output in series, converting the subfield data for a specific number of neighboring cells on the same line into parallel subfield data, and outputting the parallel subfield data to the frame memory.

In a further exemplary embodiment, the subfield data generator includes a first subfield data generator and a second subfield data generator for respectively generating subfield data corresponding to two sets of video data selected from the RGB video data, and the subfield matrix includes a first subfield matrix and a second subfield matrix for respectively receiving the subfield data output in series by the first and second subfield data generators, generating parallel subfield data corresponding to a specific number of neighboring cells, and outputting the parallel subfield data.

In yet further exemplary embodiment, the processor further includes a concatenator for concatenating the parallel subfield data output by the first and second subfield matrices, and outputting the concatenated parallel subfield data to the frame memory.

In still further exemplary embodiment, the processor further includes a data buffer for receiving the subfield data generated by the subfield data generator, dividing the subfield data into two subfield data sets, providing the two subfield data sets to the frame memory using a rising edge and a falling edge of the reference clock signal, respectively, reading the subfield data sets using the rising edge and the falling edge, respectively, of the reference clock signal, and providing the two subfield data sets to the subfield data arranger.

In yet another exemplary embodiment of the present invention, a method for processing address data in a PDP includes:

(a) generating subfield data corresponding to RGB input video data;

(b) storing the subfield data in a frame memory using a rising edge and a falling edge of a reference clock signal;

(c) reading the subfield data stored in the frame memory using the rising edge and the falling edge of the reference clock signal; and (d) arranging the subfield data read from the frame memory as address data for each subfield, and outputting the address data to the PDP to represent gray on the PDP.

In still another exemplary embodiment of the present invention, in a method for processing address data in a PDP, a recording medium is provided for storing a program for performing address data processing operations which include:

(a) generating subfield data corresponding to RGB input video data;

(b) storing the subfield data in a frame memory using a rising edge and a falling edge of a reference clock signal;

(c) reading the subfield data stored in the frame memory using the rising edge and the falling edge of the reference clock signal; and (d) arranging the subfield data read from the frame memory as address data for each subfield, and outputting the address data to the PDP to represent gray on the PDP.

In a further exemplary embodiment of the present invention, an address data processor for a PDP includes:

a subfield data generator for receiving video data having at least one color, and generating corresponding subfield data;

a frame memory for storing the subfield data using a rising edge and a falling edge of a reference clock signal, and outputting the stored subfield data using the rising edge and the falling edge of the reference clock signal; and a subfield data arranger for receiving the subfield data output by the frame memory, arranging the subfield data as address data for each subfield, and outputting the address data to represent gray on the PDP.

BRIEF DESCRIPTION OF THE DRAWINGS

The accompanying drawings, together with the specification, illustrate exemplary embodiments of the present invention, and, together with the description, serve to explain the principles of the present invention:

FIGS. 3A and 3B show timing diagrams for storing subfield data in a frame memory at the rising edges of the clock signal in the PDP address data processor of FIG. 1, in which FIG. 3A shows a case of low resolution, and FIG. 3B shows a case of high resolution;

DETAILED DESCRIPTION

In the following detailed description, only certain exemplary embodiments of the present invention are shown and described, by way of illustration. As those skilled in the art would recognize, the described exemplary embodiments may be modified in various different ways, all without departing from the spirit or scope of the invention. Accordingly, the drawings and description are to be regarded as illustrative in nature, and not restrictive.

A PDP address data processor according to an exemplary embodiment of the present invention is described below.

Figure 1:
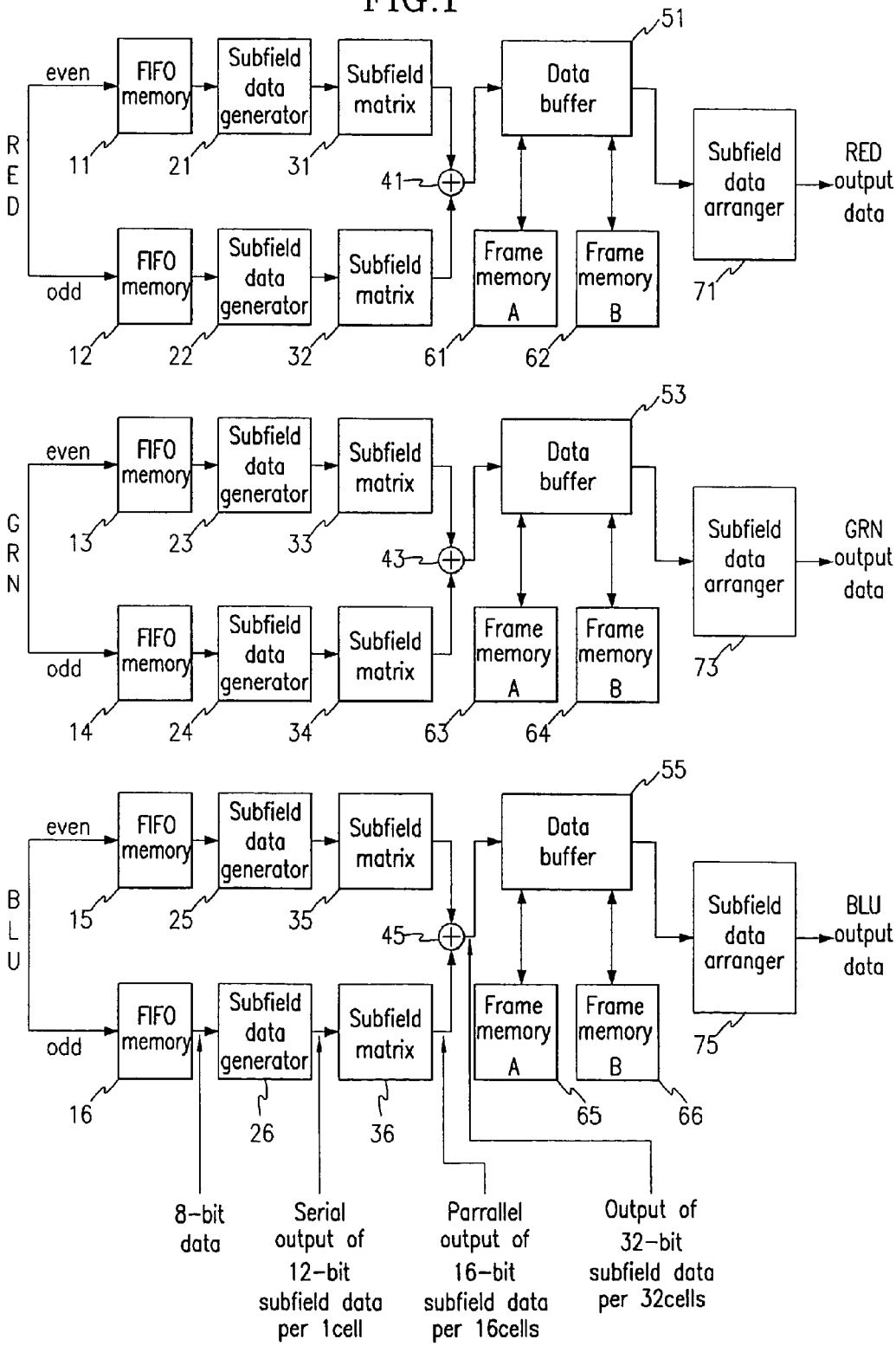
FIG. 1 shows a block diagram of a conventional PDP address data processor.
Figure 2:
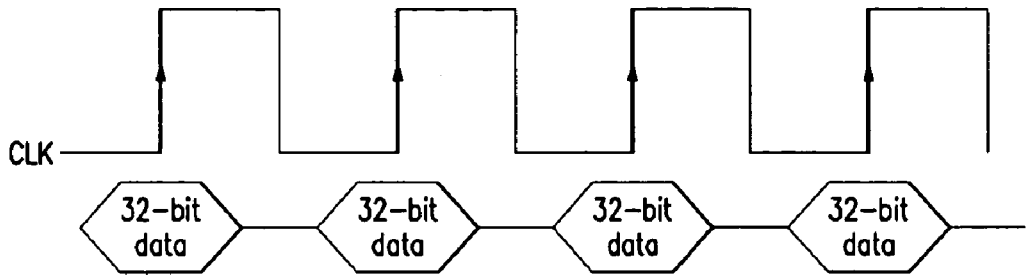
FIG. 2 shows a timing diagram for storing subfield data in a frame memory at the rising edges of the clock signal in the PDP address data processor of FIG. 1.
Figure 3A:
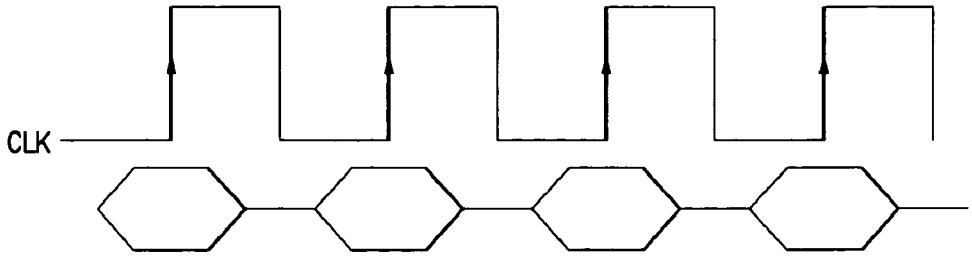
Figure 3B:
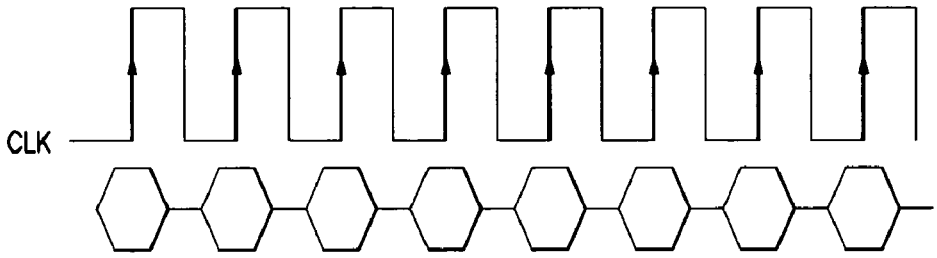
Figure 4:
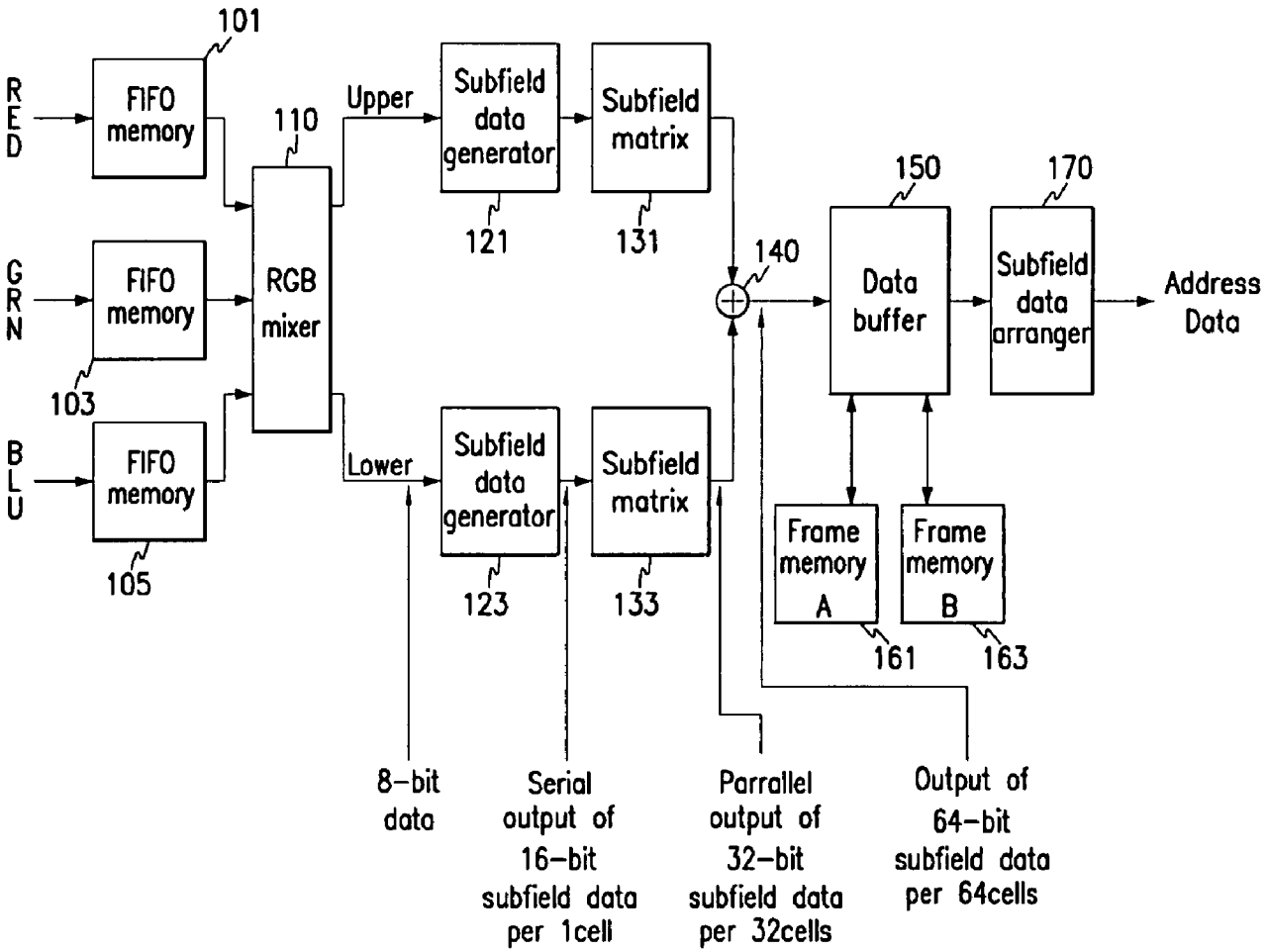
FIG. 4 shows a block diagram of a PDP address data processor according to an exemplary embodiment of the present invention.

FIG. 4 shows a block diagram of a PDP address data processor according to an exemplary embodiment of the present invention.

As shown, the PDP address data processor includes FIFO memories 101, 103, and 105, an RGB mixer 110, subfield data generators 121 and 123, subfield matrices 131 and 133, a concatenator 140, a data buffer 150, frame memories A and B 161 and 163, and a subfield data arranger 170.

The FIFO memories 101, 103, and 105 respectively receive red, green and blue components of RGB video data, and output them to the RGB mixer 110. In detail, the FIFO memory 101 processes an input of the red video data, the FIFO memory 103 processes an input of the green video data, and the FIFO memory 105 processes an input of the blue video data. Since the RGB video data are not classified and processed as even and odd data, three FIFO memories 101, 103, and 105 are sufficient to process the video data rather than six FIFO memories.

The RGB mixer 110 receives the RGB video data from the FIFO memories 101, 103, and 105, selects two sets of them according to an RGB mixing algorithm, and outputs them as 8-bit video data to the subfield data generators 121 and 123, respectively.

Here, the RGB mixing algorithm selects two sets of video data inputs from the three RGB video data, divides them as upper video data and lower video data, and outputs them. The upper video data and the lower video data are selected as a specific combination of the RGB video data, and are different from one another. In other words, the upper video data and the lower video data include two different color sets of video data selected from the RGB video data. The upper and lower video data are output in the orders of R→G→B and G →B→R, respectively. For example, as described below, when the exemplary RGB mixing algorithm is applied to the input RGB video data in the RGB mixer 110, the output of the first upper video data is red and the output of the first lower video data is green, the output of the second upper video data is green and the output of the second lower video data is blue, and the output of the third upper video data is blue and the output of the third lower video data is red.

Outputs of the upper video data: R→G→B

Outputs of the lower video data: G→B→R

By using the above-described RGB mixing algorithm, three RGB component video data outputs are processed by the two subfield data generators 121 and 123.

The subfield data generators 121 and 123 respectively receive the two sets of video data output from the RGB mixer 110, that is, the upper video data and the lower video data, generate subfield data for representing gray corresponding to the respective video data, and output the subfield data. In detail, the subfield data generator 121 generates subfield data corresponding to the upper video data output by the RGB mixer 110 and outputs them, and the subfield data generator 123 generates subfield data corresponding to the lower video data and outputs them.

In exemplary embodiments of the present invention, sixteen subfields are used, and hence, the subfield data generators 121 and 123 each generate 16-bit subfield data for each cell, and output them in series (i.e., as a serial output). Accordingly, the 16-bit subfield data output by the subfield data generators 121 and 123 relate to on/off states of the sixteen subfields for gray of a single cell, and they are arranged in series with respect to time. In other embodiments, of course, the number of subfields may be different (e.g., may be between twelve and sixteen).

The subfield matrices 131 and 133 receive serial subfield data output by the subfield data generators 121 and 123. Each subfield matrix 131 and 133 converts the serial subfield data for thirty-two neighboring cells into 32-bit parallel subfield data by arranging them according to a predetermined rule, and outputs the 32-bit parallel subfield data. In other words, the subfield matrix 131 receives the 16-bit serial subfield data output by the subfield data generator 121, generates 32-bit parallel subfield data corresponding to thirty-two cells, and outputs them, and the subfield matrix 133 receives the 16-bit serial subfield data output by the subfield data generator 123, generates 32-bit parallel subfield data corresponding to thirty-two cells, and outputs them.

For example, each of the 32-bit parallel subfield data may include on/off states for the corresponding subfield of thirty-two neighboring cells. In that case, sixteen 32-bit parallel subfield data can completely represent the gray for one of the red, green and blue video data for the thirty-two neighboring cells.

The concatenator 140 concatenates the 32-bit parallel subfield data output by the subfield matrices 131 and 133 to generate 64-bit parallel subfield data corresponding to sixty-four cells. Since the subfield matrices 131 and 133 each generate 32-bit parallel subfield data, 64-bit parallel subfield data are generated by concatenating the 32-bit parallel subfield data from the subfield matrices 131 and 133 using the concatenator 140.

The data buffer 150 receives the 64-bit parallel subfield data from the concatenator 140, and stores them in the frame memories A and B 161 and 163. In this instance, the frame memories A and B do not each store the entire 64-bit parallel subfield data output by the concatenator 140 as they have a 32-bit width for storing data.

Figure 5A:
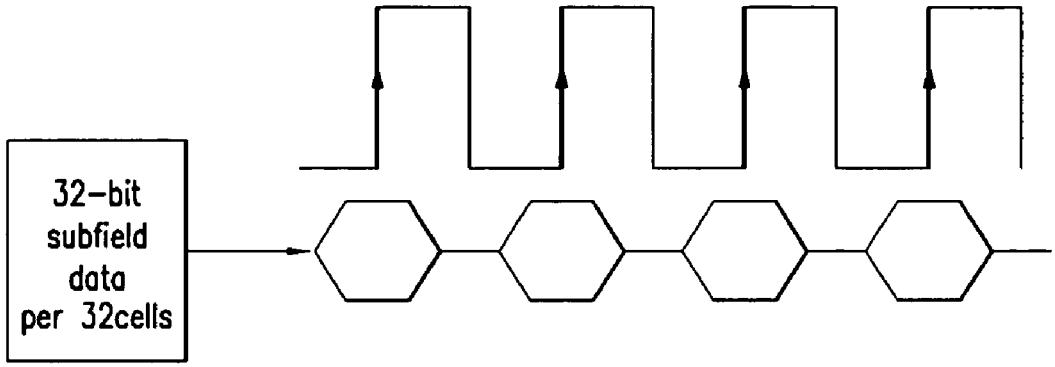
FIG. 5A shows a process and timing diagram for storing 32-bit subfield data in a frame memory using the rising edges of a clock signal in the PDP address data processor of FIG. 1.
Figure 5B:
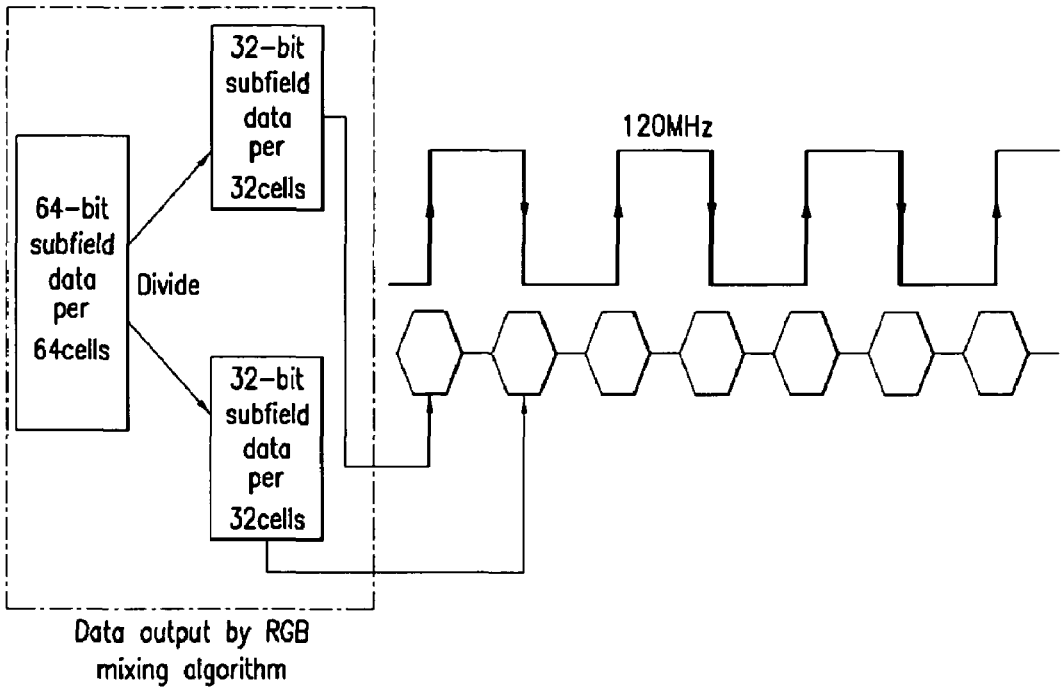
FIG. 5B shows a process and timing diagram for storing 32-bit subfield data in a frame memory using (i.e., responsive to) the rising and falling edges of a clock signal in a PDP address data processor according to one exemplary embodiment of the present invention.

Therefore, the data buffer 150 divides the 64-bit parallel subfield data output by the concatenator 140 into two 32-bit subfield data sets, and stores them in the frame memories A and B 161 and 163, respectively. In this instance, unlike the timing diagram of FIG. 5A, where 32-bit subfield data sets are stored using only the rising edges of the frame memory clock signal, first of the two 32-bit subfield data sets is stored using (i.e., responsive to) the rising edge of the frame memory clock signal, and second of the two 32-bit subfield data sets is stored using (i.e., responsive to) the falling edge thereof, when the two 32-bit subfield data sets generated from the 64-bit parallel subfield data are stored in the frame memory, as shown in FIG. 5B.

Since one 32-bit subfield data set is stored using each of the rising edge and the falling edge of one clock cycle in the frame memories A and B, the 64-bit parallel subfield data are all stored during a single clock signal period. Further, the data buffer 150 provides corresponding subfield data so that the frame memories A and B 161 and 163 may store one 32-bit subfield data using each of the rising edge and the falling edge of a single clock cycle.

In addition to storing the 64-bit parallel subfield data output by the concatenator 140 in the frame memories A and B 161 and 163, the data buffer 150 reads the 32-bit subfield data sets stored in the frame memories A and B, and outputs them to the subfield data arranger 170 which arranges the stored subfield data sets. In the same manner as storing the 64-bit parallel subfield data in the frame memories A and B 161 and 163, the data buffer 150 reads the 32-bit subfield data sets using each of the rising edge and falling edge of the frame memory clock signal. Therefore, the data buffer 150 reads the 64-bit subfield data during a single clock signal period of the frame memory clock, and outputs them to the subfield data arranger 170.

The subfield data arranger 170 receives the 64-bit subfield data from the data buffer 150, arranges them as address data needed for addressing each subfield, and outputs the address data to represent gray on the PDP. In one exemplary embodiment, the data buffer 150 reads the 32-bit subfield data using both the rising edges and the falling edges from the frame memories A and B, and outputs them to the subfield data arranger 170. In another exemplary embodiment, the data buffer 150 concatenates the 32-bit subfield data read using the rising and falling edges, respectively, into 64-bit subfield data, and outputs the 64-bit subfield data to the subfield data arranger 170.

As described, when accessing the subfield data of the frame memories A and B, that is, when storing and reading the 32-bit subfield data sets, the data buffer 150 accesses the 32-bit subfield data set using each rising edge and falling edge of the frame memory clock signal. Therefore, the data buffer 150 stores or reads 64-bit subfield data during a single frame memory clock signal period. As a result, the HD-level resolution can be displayed using a lesser number of frame memories without correspondingly increasing the frequency of the frame memory clock compared to the address data processing device using a conventional frame memory.

Figure 6:
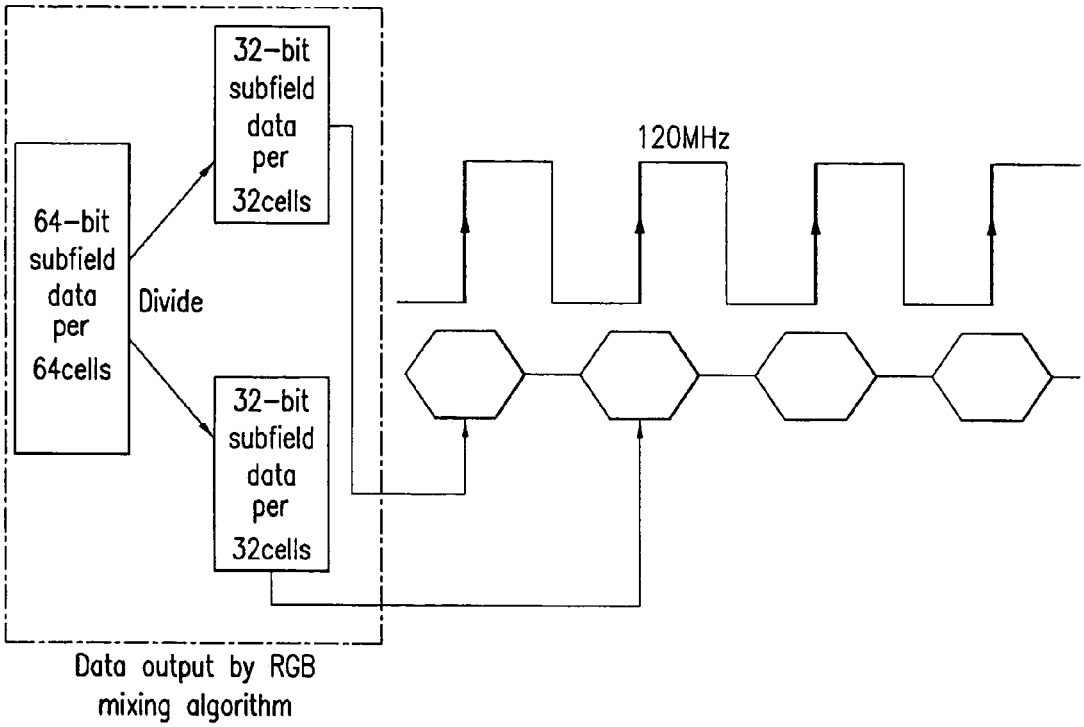
FIG. 6 shows a process and timing diagram that would result if an RGB mixing algorithm according to an exemplary embodiment of the present invention were applied to store subfield data in a frame memory using rising edges of a clock signal.

FIG. 6 shows a timing diagram that would result if an RGB mixing algorithm according to an exemplary embodiment of the present invention were applied to a conventional frame memory.

When the data buffer 150 divides the 64-bit parallel subfield data corresponding to the sixty-four cells generated by the RGB mixing algorithm into two 32-bit subfield data sets, and stores the 32-bit subfield data sets in a frame memory using only the rising edges, one frame data set of a single line corresponds to 67,584 bits (1,408×3(RGB)×16 subfields), and a number of frame memory clock cycles used for storing the one frame data set in the conventional frame memory is 2,112 (=67,584 bits/32 bits). In this instance, since four clock cycles are additionally needed because of RAS (row address strobe) and CAS (column address strobe) delay per four clock cycles for storing data in the frame memory, 4,224 clock cycles (=2112+(2112/4)×4) are needed for storing 67,584-bit video data. The time of 35.186 μs (=8.33 ns×4,224) is needed for storing the 67,584-bit video data since one clock signal period is 8.33 ns when a 120 MHz frame memory clock is used.

Since a single horizontal sync time of about 21.5 μs is used to display video with an HD-level resolution, the time of 35.186 μs used for representing the 67,584 bits is greater than the available time. Hence, one line of frame data cannot be stored in the frame memory during a single horizontal sync time. Therefore, since the conventional frame memory cannot use the RGB mixing algorithm according to the exemplary embodiments of the present invention, a frame memory that allows storing and reading subfield data using both the rising and falling edges of the frame memory clock signal should be used.

In the case of applying the RGB mixing algorithm to the frame memory according to the exemplary embodiment of the present invention, since 64 bits are stored per single clock, 2,112 clock cycles (=1056+(1,056/4)×4) are needed for storing 67,584 bits which are one line frame data since 4 clock cycles are added to each group of four clock cycles of 1,056 clock cycles (=67,584 bits/64 bits) because of the RAS and CAS delay. Since one clock signal is 8.33 ns when using 120 MHz frame memory clock signals, the time of 17.593 μs (=8.33 ns×2,112) is used so as to store 67,584-bit video data.

The time of 17.593 μs is less than one horizontal sync time of 21.51 μs by substantially 4 μs, which allows for some margin. Therefore, one line of video data is stored in the frame memory during one horizontal sync time.

In order to obtain the margin of 4 μs by using the RGB mixing algorithm on a conventional frame memory, the clock signal frequency should be 240 MHz (∵ Tns×4,224=17.593

μs →T=4.165 μs →Clock signal frequency =240 MHz) which is twice the clock frequency of 120 MHz. When using the above-noted high clock frequency, video data may be lost because of short margins of the setup time and the hold time of the frame memory.

Figure 7:
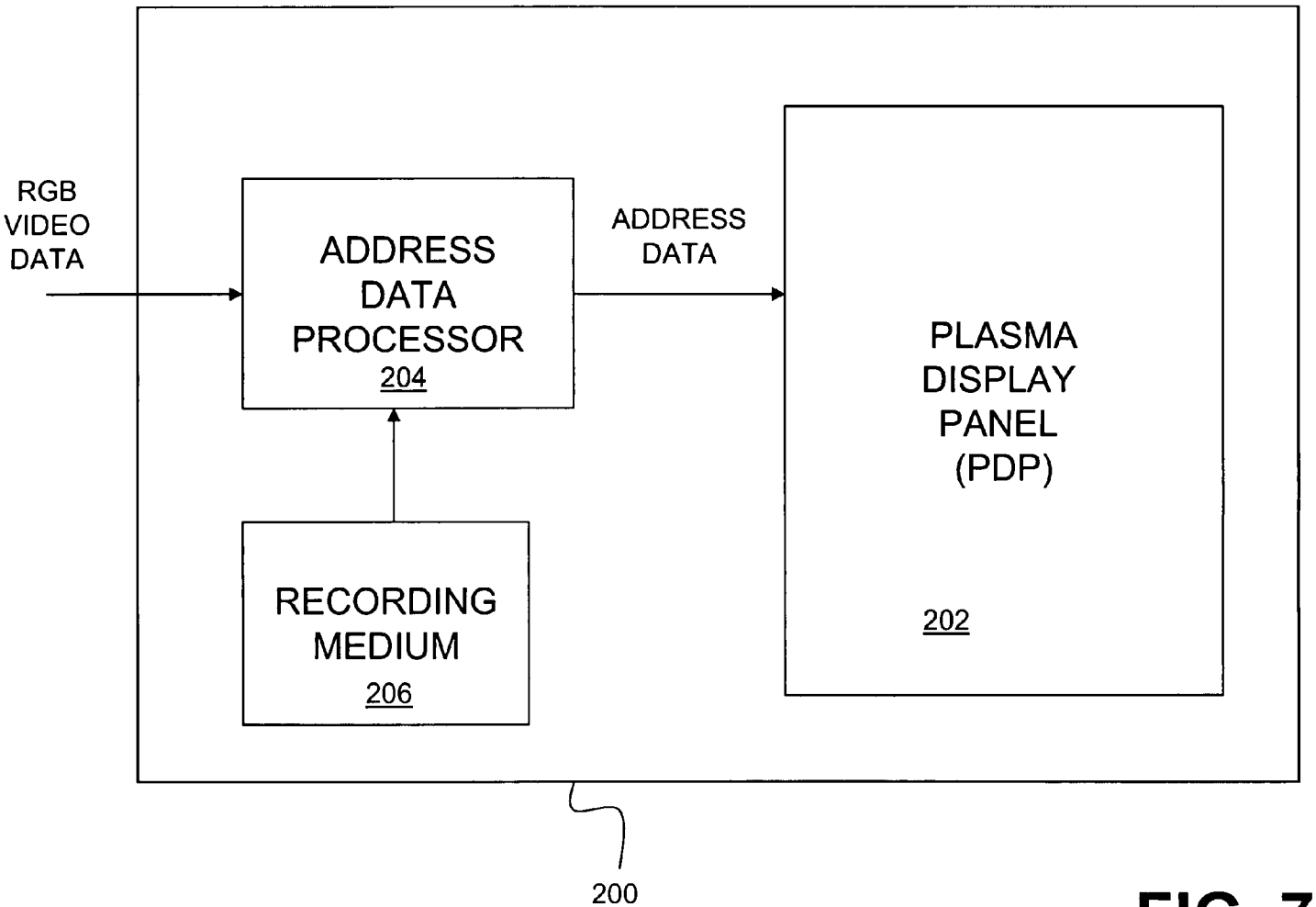
FIG. 7 is a block diagram of a PDP display system, which includes the PDP address data processor and a recording medium of the present invention.

FIG. 7 is a block diagram of a PDP display system 200, which includes a PDP 202, an address data processor 204 and a recording medium 206. The address data processor 204 receives RGB video data, and converts the RGB video data into address data for addressing subfields of the PDP 202: The PDP 202 generates images responsive to the address data. The address data processor 204 may be identical to the exemplary address data processor of FIG. 4. While the data buffer and the frame memories A and B are indicated in FIG. 7 to be a part of the address data processor 204, the data buffer and the frame memories may implemented as an external memory (e.g., in the system memory), which is not an integral part of the address data processor 204.

The recording medium 206 contains a program (i.e., software) for performing operations of the address data processor 204, which is described above. The recording medium may include read-only memory (ROM), random access memory (RAM), application specific integrated circuit (ASIC) and/or any other data storage device known to those skilled in the art. In other embodiments, the recording medium may actually be an integral part of the address data processor implemented in hardware and/or firmware.

While the present invention has been described in connection with certain exemplary embodiments, it is to be understood that the present invention is not limited to the disclosed embodiments, but, on the contrary, is intended to cover various modifications and equivalent arrangements included within the spirit and scope of the appended claims.

In the described exemplary embodiment, the RGB mixing algorithm executed by the RGB mixer 110 selects two video data sets from among the RGB video data, and output the video data sets as upper video data and lower video data. In other embodiments, when the RGB video data can be separated into two different outputs, the separated two different outputs are output as upper video data and lower video data. For example, the RGB video data can be divided into even data and odd data, which can be output, respectively, as upper video data and lower video data.

According to exemplary embodiments of the present invention, a lesser number of frame memories is used, and the subfield data needed for representing the HD-level resolution are processed within a predetermined time period without increasing the clock signal frequency. Also, the number of FIFO memories, subfield data generators, subfield matrixes, and frame memories used are reduced, thereby reducing power consumption, reducing or eliminating calorific problems. As a result, reliability of the system is improved.

What is claimed is:

1. An address data processor for a plasma display panel (PDP), comprising:

an RGB mixer for receiving RGB video data, and selecting data as a specific combination of the RGB video data;

a subfield data generator for receiving the selected data, and generating corresponding subfield data;

a frame memory for storing the subfield data using a rising edge and a falling edge of a reference clock signal, and outputting the stored subfield data using the rising edge and the falling edge of the reference clock signal; and a subfield data arranger for receiving the subfield data output by the frame memory, and arranging the received subfield data as address data for each subfield.

2. The processor of claim 1, wherein the subfield data is divided, and wherein the frame memory stores the divided subfield data using the rising edge and the falling edge of the reference clock signal, and outputs the stored divided subfield data using the rising edge and the falling edge of the reference clock signal.

3. The processor of claim 1, wherein the specific combination includes two different color sets of video data selected from the RGB video data.

4. The processor of claim 3, wherein a selection order of the two different color sets of video data follows R→G→B and G→B→R, respectively.

5. The processor of claim 1, further comprising a subfield matrix for receiving the subfield data generated by the subfield data generator and output in series, converting the subfield data for a specific number of neighboring cells on the same line into parallel subfield data, and outputting the parallel subfield data to the frame memory.

6. The processor of claim 5, wherein the subfield data generator comprises a first subfield data generator for generating subfield data corresponding to one set of two sets of the specific combination of the RGB video data and a second subfield data generator for generating subfield data corresponding to the other set of the two sets, and the subfield matrix comprises a first subfield matrix and a second subfield matrix for respectively receiving the subfield data output in series by the first and second subfield data generators, generating parallel subfield data corresponding to a specific number of neighboring cells, and outputting the parallel subfield data.

7. The processor of claim 6, further comprising a concatenator for concatenating the parallel subfield data output by the first and second subfield matrices, and outputting the concatenated parallel subfield data to the frame memory.

8. The processor of claim 1, further comprising a data buffer for receiving the subfield data generated by the subfield data generator, dividing the subfield data into two subfield data sets, providing the two subfield data sets to the frame memory using the rising edge and the falling edge of the reference clock signal, respectively, reading the subfield data sets using the rising edge and the falling edge, respectively, of the reference clock signal, and providing the two subfield data sets to the subfield data arranger.

9. The processor of claim 8, wherein the frame memory comprises a first frame memory and a second frame memory, and wherein a first subfield data set of the two subfield data sets is stored in the first frame memory and a second subfield data set of the two subfield data sets is stored in the second frame memory.

10. The processor of claim 9, wherein the data buffer provides the first subfield data set to the first frame memory responsive to the rising edge of the reference clock signal, and provides the second subfield data set to the second frame memory responsive to the falling edge of the reference clock signal.

11. The processor of claim 9, wherein the data buffer reads the first subfield data set from the first frame memory responsive to the rising edge of the reference clock signal, and reads the second subfield data set from the second frame memory responsive to the falling edge of the reference clock signal.

12. A method for processing address data in a plasma display panel (PDP), comprising:

receiving RGB video data;

selecting video data as a specific combination from the RGB video data;

generating subfield data corresponding to the selected video data;

storing the subfield data in a frame memory using a rising edge and a falling edge of a reference clock signal;

reading the subfield data stored in the frame memory using the rising edge and the falling edge of the reference clock signal; and arranging the subfield data read from the frame memory as address data for each subfield, and outputting the address data.

13. The method of claim 12, further comprising dividing the subfield data, wherein the storing the subfield data comprises storing the divided subfield data in the frame memory using the rising edge and the falling edge of the reference clock signal, and the reading the subfield data comprises reading the divided subfield data stored in the frame memory using the rising edge and the falling edge of the reference clock signal.

14. The method of claim 12, wherein the specific combination includes two sets of video data selected from the RGB video data.

15. The method of claim 14, wherein a selection order of one set of the two sets follows R→G→B and a selection order of the other set of the two sets follows G→B→R.

16. The method of claim 12, wherein the subfield data are output in series, and the method further comprises, receiving the subfield data output in series;

converting the subfield data for a specific number of neighboring cells on the same line into parallel subfield data; and outputting the parallel subfield data to the frame memory.

17. The method of claim 15, wherein the generating subfield comprises, generating a first subfield data and a second subfield data corresponding to the selected two sets of video data, and outputting each of the first and second subfield data in series, receiving the first and second subfield data output in series, generating first parallel subfield data using the first subfield data and generating second parallel subfield data using the second subfield data, and outputting the first and second parallel subfield data.

18. The method of claim 17, further comprising, after outputting the first and second parallel subfield data, concatenating the first and second parallel subfield data into a single parallel subfield data, and providing the concatenated parallel subfield data to the frame memory.

19. The method of claim 18, wherein the frame memory comprises a first frame memory and a second frame memory, the method further comprising dividing the concatenated parallel subfield data into first subfield data set and a second subfield data set.

20. The method of claim 19, further comprising storing the first subfield data set in the first frame memory responsive to the rising edge of the reference clock signal, and storing the second subfield data set in the second frame memory responsive to the falling edge of the reference clock signal.

21. The method of claim 19, further comprising reading the first subfield data set from the first frame memory responsive to the rising edge of the reference clock signal, and reading the second subfield data set from the second frame memory responsive to the falling edge of the reference clock signal.

22. An address data processor for a plasma display panel (PDP), comprising:

an RGB mixer for receiving RGB video data, selecting at least two sets of video data as a specific combination of the RGB video data, and outputting the selected data;

a subfield data generator for receiving the selected data, and generating corresponding subfield data;

a frame memory for storing the subfield data using a rising edge and a falling edge of a reference clock signal, and outputting the stored subfield data using the rising edge and the falling edge of the reference clock signal; and a subfield data arranger for receiving the subfield data output by the frame memory, and arranging the received subfield data as address data for each subfield.

* * * * *